US012031336B2

(12) United States Patent
Huss

(10) Patent No.: US 12,031,336 B2
(45) Date of Patent: Jul. 9, 2024

(54) INTEGRATED MAT ASSEMBLY AND METHOD OF USE

(71) Applicant: Wearwell, LLC, Smyrna, TN (US)

(72) Inventor: Philip C. Huss, Smyrna, TN (US)

(73) Assignee: Wearwell, LLC, Smyrna, TN (US)

( * ) Notice: Subject to any disclaimer, the term of this patent is extended or adjusted under 35 U.S.C. 154(b) by 0 days.

(21) Appl. No.: 17/868,094

(22) Filed: Jul. 19, 2022

(65) Prior Publication Data

US 2022/0349187 A1 Nov. 3, 2022

Related U.S. Application Data

(63) Continuation of application No. 17/002,974, filed on Aug. 26, 2020, now abandoned.

(51) Int. Cl.

| | |
|---|---|
| ***E04F 15/02*** | (2006.01) |
| ***E04F 15/024*** | (2006.01) |
| *A47G 27/02* | (2006.01) |
| *A47L 23/26* | (2006.01) |

(52) U.S. Cl.
CPC .. *E04F 15/02005* (2013.01); *E04F 15/02172* (2013.01); *E04F 15/02405* (2013.01)

(58) Field of Classification Search
CPC ..... E04F 15/02005; E04F 15/02172; E04F 15/02405
USPC ..... 52/578
See application file for complete search history.

(56) References Cited

U.S. PATENT DOCUMENTS

| | | | | |
|---|---|---|---|---|
| 2,142,305 A | | 1/1939 | Davis | |
| 2,202,636 A | * | 5/1940 | McClelland | A47L 23/24 52/181 |
| 2,449,904 A | * | 9/1948 | Lorraine | A47G 27/045 16/7 |
| 2,810,671 A | * | 10/1957 | Taylor | B60N 3/044 428/101 |
| 3,300,275 A | * | 1/1967 | Lorman | A47L 23/266 604/293 |
| 3,310,919 A | | 3/1967 | Bue | |
| 3,347,048 A | * | 10/1967 | Brown | E02B 3/14 52/592.4 |
| 3,434,715 A | * | 3/1969 | Brantingham | A63B 21/4037 482/79 |
| 3,667,177 A | * | 6/1972 | Biela | E04F 19/06 4/496 |
| 3,808,628 A | | 5/1974 | Betts | |

(Continued)

FOREIGN PATENT DOCUMENTS

| | | | | |
|---|---|---|---|---|
| EP | 2868834 | | 5/2015 | |
| FR | 2881158 A1 | * | 7/2006 | B26B 29/06 |

(Continued)

*Primary Examiner* — Brian D Mattei
*Assistant Examiner* — Joseph J. Sadlon
(74) *Attorney, Agent, or Firm* — Clark & Brody LP

(57) ABSTRACT

A mat assembly includes a center section and four ramps that create a unitary mat assembly for any desired use. The center section includes a top plate that provides the desired kind of mat surface for use and a sponge layer underlying the top plate to provide the center section with a cushioned feel during use. Each ramp includes a flange that extends from an end portion of the ramp, the flange configured to be joined between the top plate and sponge insert. The ramps can be joined to each other using a connector or a mitered connection.

10 Claims, 11 Drawing Sheets

(56) References Cited

U.S. PATENT DOCUMENTS 3,877,190 A * 4/1975 Corcoran, Jr. ..... E04B 9/24 52/506.08
3,953,631 A * 4/1976 Gordon ..... A47L 23/266 264/552
4,029,834 A 6/1977 Bartlett
4,142,341 A * 3/1979 Mott ..... E04F 15/02441 52/263
4,267,679 A * 5/1981 Thompson ..... E04B 1/80 52/545
4,373,306 A * 2/1983 Rech ..... E01C 5/20 52/590.1
4,468,910 A 9/1984 Morrison
4,716,704 A * 1/1988 Murr ..... E04F 19/06 52/471
4,755,401 A * 7/1988 Friedrich ..... A63C 19/065 428/17
4,804,570 A 2/1989 Bedics
4,829,627 A * 5/1989 Altus ..... B60N 3/046 16/8
4,973,505 A 11/1990 Bielous
5,018,235 A 5/1991 Stamatiou
5,114,774 A 5/1992 Maxim, Jr.
5,142,733 A * 9/1992 Mogel ..... A47G 27/0481 16/8
5,203,640 A * 4/1993 Pourtau ..... E04F 15/02027 52/287.1
5,299,330 A * 4/1994 Moore ..... A47K 3/405 4/612
5,341,533 A * 8/1994 Seitz ..... E01C 11/222 254/88
5,446,937 A 9/1995 Haskins
5,509,244 A 4/1996 Bentzon
5,556,685 A * 9/1996 Swicegood, Jr. ..... A47L 23/26 428/95
5,848,830 A * 12/1998 Castle ..... G09F 19/228 362/276
6,032,427 A * 3/2000 Randjelovic ..... E04F 15/22 52/584.1
6,093,469 A 7/2000 Callas
6,128,881 A 10/2000 Bue et al.
6,189,283 B1 2/2001 Bentley et al.
6,446,413 B1 9/2002 Gruber
6,505,444 B1 1/2003 Johnson
6,578,324 B2 6/2003 Kessler et al.
6,584,739 B2 * 7/2003 Zeif ..... E04F 15/02417 52/177
6,589,631 B1 * 7/2003 Suzuki ..... B29C 37/0075 428/187
6,598,366 B2 * 7/2003 Hsieh ..... E04F 15/02411 52/509
6,740,380 B2 5/2004 Kessler
6,793,586 B2 * 9/2004 Barlow ..... A63B 67/02 473/162
6,926,643 B1 * 8/2005 Gvoich ..... A63B 23/0458 482/52
6,954,975 B2 10/2005 Dolinski
7,144,139 B2 * 12/2006 Kramer ..... A63B 57/40 52/578
7,690,160 B2 4/2010 Moller, Jr.
7,832,044 B2 11/2010 Kessler
7,841,151 B2 11/2010 Uhlig
7,900,294 B2 3/2011 Luxton et al.
7,993,726 B2 * 8/2011 Johnson ..... B32B 7/022 428/101
8,006,443 B2 8/2011 Fuccella et al.
8,322,087 B1 12/2012 Lascano
8,444,287 B2 5/2013 Hardesty
8,826,609 B1 * 9/2014 Chang ..... E04F 15/02161 52/579
8,919,054 B2 12/2014 Tillery et al.
8,935,822 B2 * 1/2015 Frederiksen ..... E04F 11/002 14/69.5
9,260,871 B2 * 2/2016 Shaw ..... E04F 19/0463
9,289,085 B2 3/2016 Thrush
9,321,242 B1 * 4/2016 Siegel ..... A61M 1/84
9,506,245 B2 * 11/2016 Mackintosh ..... E01F 3/00
9,506,255 B1 11/2016 Jones et al.
9,593,494 B2 * 3/2017 Frenette ..... E04F 19/063
9,714,516 B1 * 7/2017 Hernandez ..... E04F 13/0803
9,771,725 B2 9/2017 Matchung
10,137,639 B2 11/2018 Neill et al.
10,156,045 B2 12/2018 Penland
10,208,489 B2 2/2019 Walens et al.
10,582,793 B1 * 3/2020 McMahan ..... B32B 5/32
10,689,155 B2 * 6/2020 Sullivan ..... B65D 11/1873
10,722,991 B2 7/2020 Gmitro
10,842,303 B1 11/2020 Vieveen
10,850,471 B2 * 12/2020 Dawson ..... D06N 7/0071
11,000,142 B2 * 5/2021 Girard ..... F21S 4/22
11,473,314 B2 * 10/2022 Heatwole ..... A47G 27/045 52/582.1
11,634,914 B2 * 4/2023 Meersseman ..... E04F 15/02 52/309.3
2001/0017015 A1 * 8/2001 Schluter ..... E04F 15/02005 52/396.04
2002/0020123 A1 2/2002 Kessler et al.
2003/0024062 A1 * 2/2003 McKay ..... A47L 13/20 15/215
2003/0091782 A1 * 5/2003 Burke, III ..... B29C 59/02 264/293
2003/0154662 A1 8/2003 Bruch
2003/0186025 A1 * 10/2003 Scott ..... E04F 15/185 428/119
2004/0019994 A1 2/2004 Kessler et al.
2004/0206038 A1 * 10/2004 Stanchfield ..... A47G 27/045 52/582.1
2005/0158501 A1 * 7/2005 O'Connor ..... E04F 11/104 428/95
2006/0014009 A1 1/2006 Weidner
2006/0177626 A1 * 8/2006 Johnson ..... B32B 27/30 428/99
2007/0214741 A1 * 9/2007 Llorens Miravet ..... E04F 15/02 52/592.1
2008/0148666 A1 * 6/2008 Degen ..... E04F 13/0837 52/506.1
2017/0136730 A1 * 5/2017 Dawson ..... B32B 5/024
2018/0042420 A1 * 2/2018 Johnson ..... E04F 15/02 52/309.3
2022/0025655 A1 * 1/2022 Everard ..... A47G 27/0243

FOREIGN PATENT DOCUMENTS

GB 2435056 A * 8/2007 ..... E04F 15/02172
JP 2003-275161 9/2003
WO WO-2019119140 A1 * 6/2019 ..... B32B 3/06

* cited by examiner

INTEGRATED MAT ASSEMBLY AND METHOD OF USE

FIELD OF THE INVENTION

A unitary mat assembly is provided that includes a cushioned center section and ramps integrally connected to the periphery of the center section, and more particularly, a unique ramp configuration that minimizes any lifting of the ramp ends during use of the mat assembly and possible tripping hazards and provides a robust attachment between the ramp and center section without visibly showing the attachment details.

BACKGROUND ART

Floor mat designs widely vary in the prior art. One type uses connectors on peripheral edges of the mat so that mats can be linked together to provide more mat coverage. Another type of mat is a unitary one, i.e., a single mat, which is provided with a ramp structure along its periphery and does not use peripheral connectors to link to another mat.

FIG. 1 shows a sectional view of a part of such a mat, which is designated by the reference numeral 10, and its ramp section. The mat 10 includes a sponge layer 1 and a top plate 3 adhered to the sponge layer 1 in any known fashion. The top plate 3 has protrusions 5 extending from a top surface thereof for slip resistance and includes a ramp section 7 that extends beyond an end face 9 of the sponge layer 1. The sponge layer 1 is tapered at a peripheral end portion 11 thereof so that the top plate 3 angles downwardly to form the ramp section 7. In order for an end portion 13 of the ramp section 7 to contact the floor surface, the sponge layer 1 is sized to leave a space 14 beneath a portion of the ramp section so that ramp section 7 can terminate at the ground surface 15. The problem with this design is that the entire ramp section 7 is not secured in any way and, over time, the ramp end portion 13 can curl up and cause a tripping hazard or the like. Also, the ramp end portions can also tear, which would require mat repair or replacement.

As such, a need exists to provide an improved unitary mat assembly that avoids tripping hazards, damage to the ramp portions of the mat, and the like. The present invention responds to this need by providing an improved mat assembly that employs a separate ramp section that is configured to securely attach to the center section of the mat assembly and retain its ramp configuration during use of the mat assembly.

SUMMARY OF THE INVENTION

One object of the invention is to provide an improved unitary mat assembly.

Another object is to provide a mat assembly which resists the edges of the mat assembly turning up and causing a tripping hazard.

Yet another object of the invention is the use of the improved mat assembly to cover an area and provide cushioned support to a mat user.

In one embodiment, the mat assembly includes a center section having a peripheral portion, the center section comprising a sponge layer and a top layer, a center portion of each of the top layer and the sponge layer secured together.

Also provided as part of the mat assembly are a plurality of ramps. Each ramp has an inclined or angled top portion, a bottom portion, and a connecting flange. One end of the inclined top portion terminates at a free end of the ramp, the free end extending longitudinally along the ramp. The ramp can also have a plurality of channels extending longitudinally along the ramp, wherein adjacent channels are separated by a member extending between the inclined top portion and bottom portion of the ramp. The ramp also has opposing end portions.

The connecting flange is positioned between an underside portion of the top layer and an upper surface portion of the sponge layer, each portion being in the peripheral portion of the center section, wherein the connecting flange, underside portion and upper surface portion are attached together to form an integral connection between the ramp and mat center section. The end portions of adjacent ramps are also configured to be attached together.

In one embodiment, the end portions of adjacent ramps are connected together using a plurality of corner connectors. Each corner connector has opposing side faces with each opposing side face configured to attach to an adjacent end portion of one of the plurality of ramps. In another embodiment for adjacent ramp connections, at least one end portion of at least two of the ramps is angled with respect to a longitudinal axis of the ramp. The angled end portions attach together by a bonding of the end portions or by use of fasteners, or a combination thereof.

The bottom portion of each ramp can be inclined when the ramp is attached to the center section such that only the free end of the ramp is in contact with a floor surface. The connecting flange can have at least a portion that is tapered in thickness and/or be angled downwardly as compared to an upper surface of the top plate. The downward angling of the connecting flange assists in keeping the edge of the ramp on a floor or ground as the flange angling is changed when the ramp and center section are assembled into the mat assembly.

For the corner connectors, each corner connector can include a plurality of tree connectors or other kinds of connectors, each tree connector configured to engage one of the channels in the ramp.

The top plate of the mat assembly can have any known configuration, including one with protrusions extending from an upper surface of the top plate for slip resistance or a smooth surfaced top plate. The ramp and corner connectors could also have configurations matching the top plate in terms of means for slip resistance or different surface combinations, e.g., the ramps and top plate would have protrusions, ribs, or the like and the corner connectors would be smooth surfaced.

The invention also includes the use of the inventive mat assembly to cover a desired floor surface to provide cushioned support for a user that would use the desired floor surface.

DETAILED DESCRIPTION OF THE INVENTION

Figure 1:
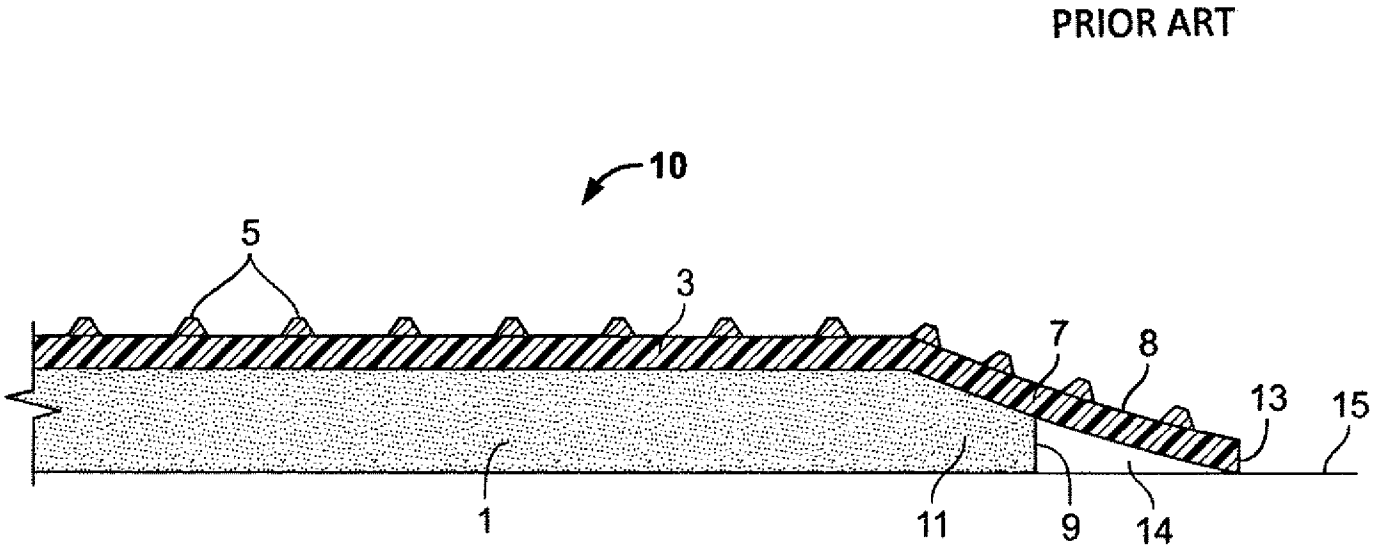
FIG. 1 shows a schematic of a portion of a prior art mat.

The inventive mat assembly offers a number of advantages over the mat assembly designs of the prior art, including the one depicted in FIG. 1. With the ramp construction and its attachment to the center section of the mat, there is little or no possibility that the ramp end portion can curl up at its free end to create a tripping hazard.

Moreover, the use of a specially configured flange on the ramp to interface with both the top plate and sponge layer of the center section provides a more robust attachment between the ramps and center section and provides a more durable mat assembly.

The flange is also specially configured so that the part of the connection between the flange and top plate is either not seen or less visible as an irregularity in the surface of the top plate, e.g., a line following the edge of the flange, that would take away from the overall look of the mat assembly.

The ramp is also preferably formed as an extrusion that allows the ramp to have internal strengthening members, which also facilitate connections between adjacent ramps when a connector at each corner of the mat assembly is used.

Figure 2:
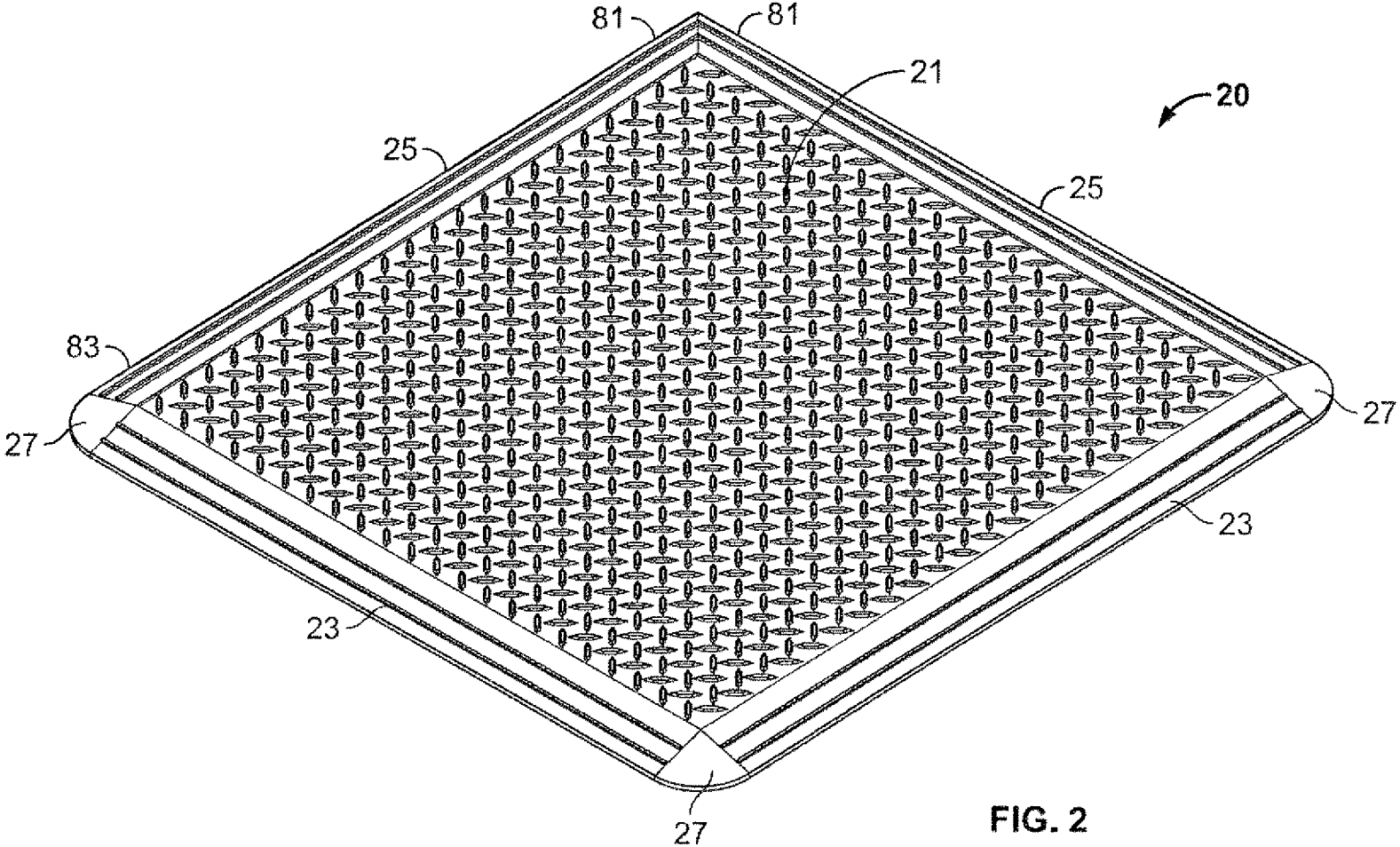
FIG. 2 shows a perspective top side view of one embodiment of the inventive mat assembly.
Figure 3:
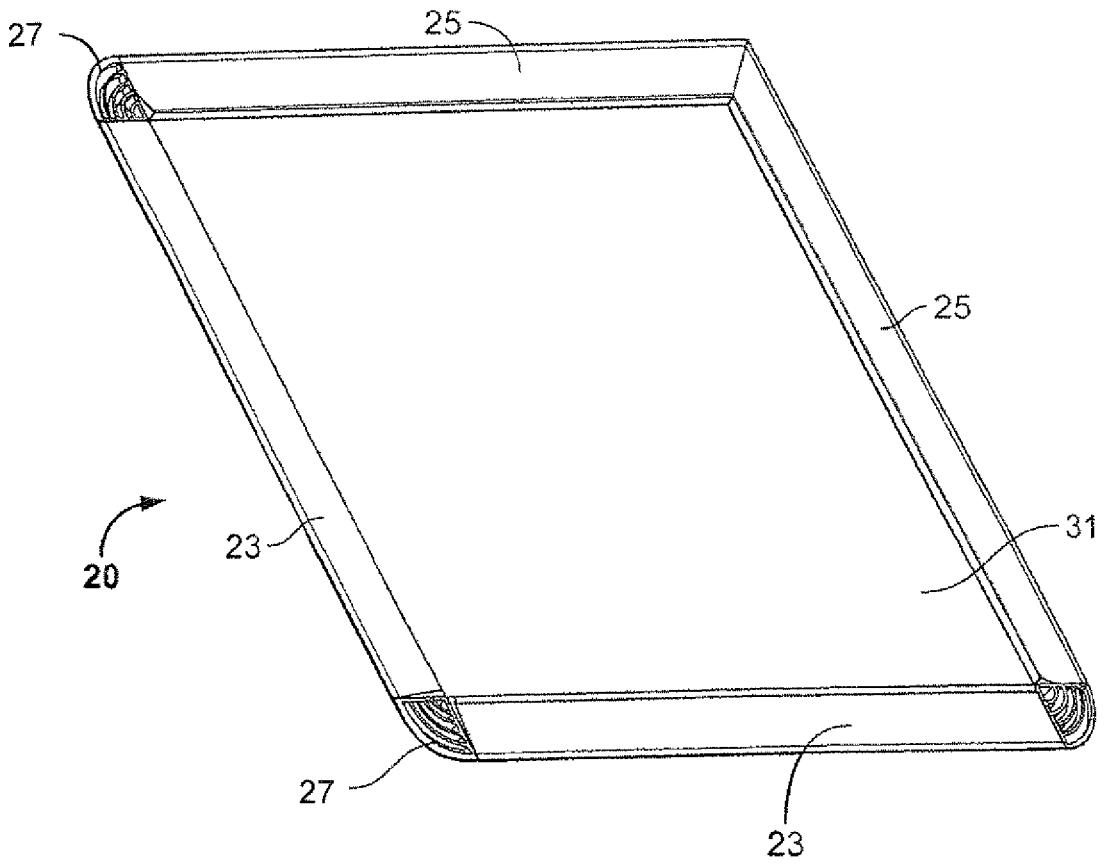
FIG. 3 shows an underside perspective view of the mat assembly of FIG. 2.

FIGS. 2 and 3 show one embodiment of the inventive mat assembly that is designated by the reference numeral 20. The mat assembly 20 includes a center section 21, and four ramps surrounding the center section 21. It should be understood that the mat assembly 20 of FIG. 2 is illustrated to show two different kinds of ramps and ramp end connections.

One ramp is designated by the reference numeral 23 and the other ramp is designated by the reference numeral 25. Depending on a given mat assembly construction, a mat could have four of the ramps 23 or four of the ramps 25. If so desired, the mat assembly could be configured as shown in FIG. 2 with two of each kind of ramp.

If ramps 23 are used in a given mat assembly, a connector 27 is included to facilitate the connection between adjacent ends of the ramps 13. Details of the connector are provided below.

Figure 4:
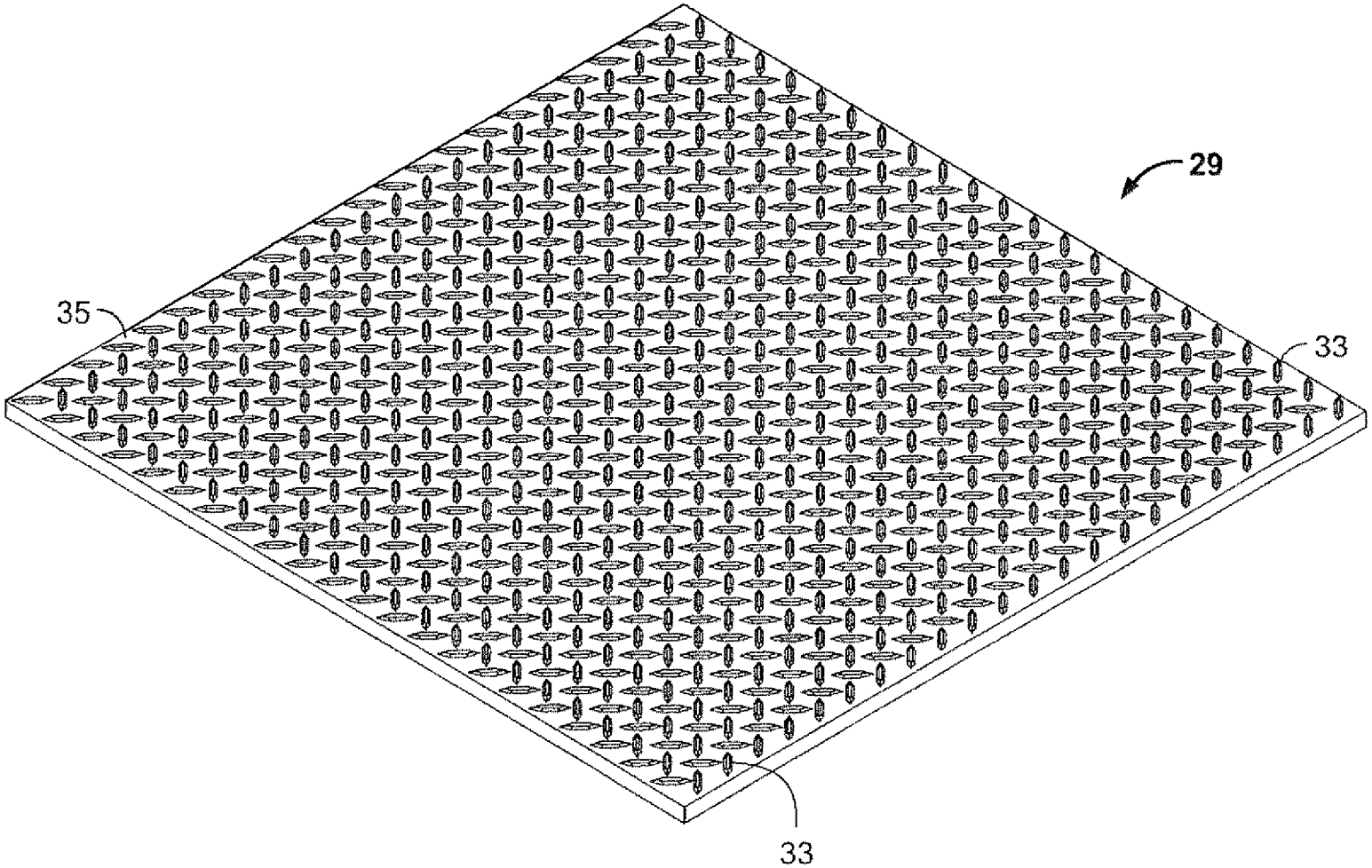
FIG. 4 shows a perspective view of the top plate of the center section of the mat assembly of FIG. 2.
Figure 5:
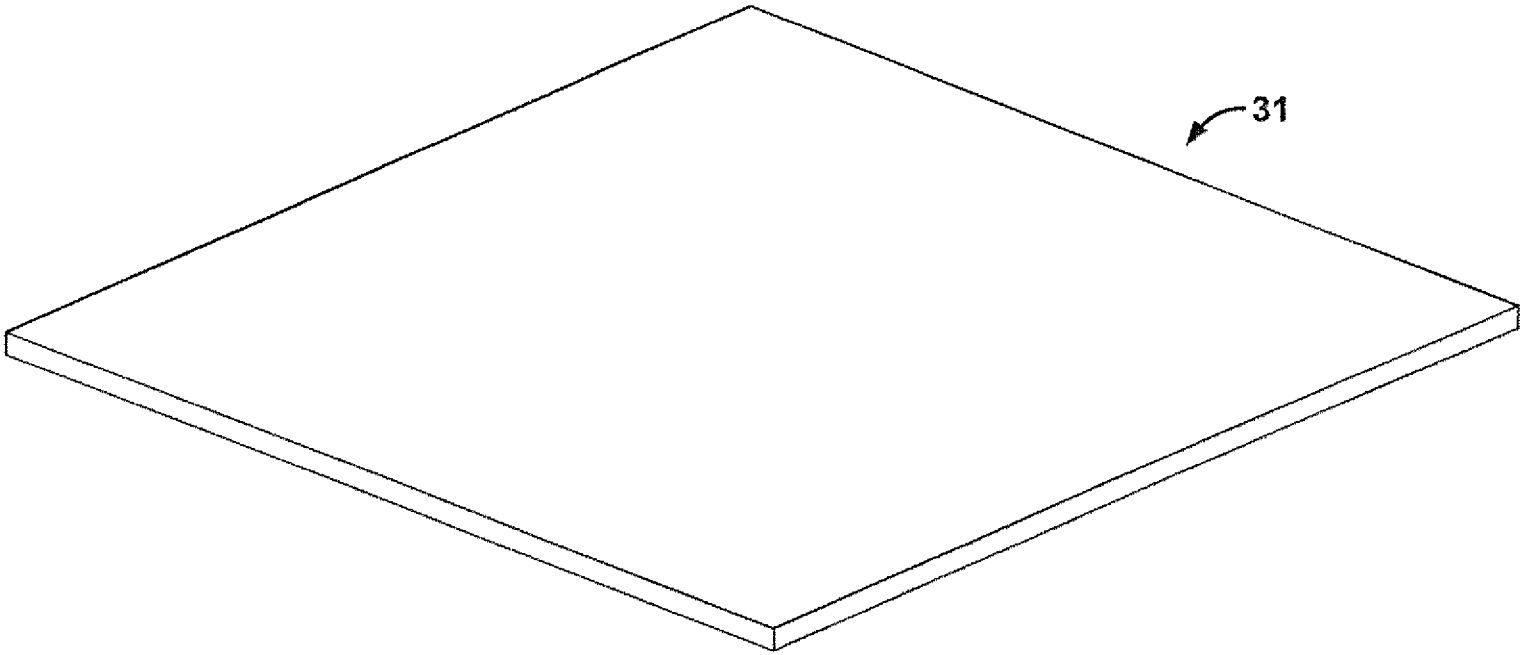
FIG. 5 shows a perspective view of the sponge layer of the center section of the mat assembly of FIG. 2.

Referring now to FIGS. 2-5, the center section 21, see FIG. 2, of the mat assembly includes a top plate 29, see FIG. 4, and a sponge layer 31, see FIG. 5. The top layer is shown with a plurality of protrusions 33 extending from a top surface 35 thereof. The protrusions 33 provide slip resistance for the mat assembly 20. The protrusions are exemplary and other slip resistant features could be employed as part of the mat top surface. In the alternative, the mat top surface 35 could be smooth if slip resistance was not required for a given mat assembly use.

The top plate 29 and sponge layer 31 are sized to match, with center portions of the top plate 29 and the sponge layer 31 joined together to form a laminate construction. The joining of the top plate 29 and sponge layer 31 can be any known type, adhesive, heat welding, or the like.

The sponge layer 31 can be made of any known resilient material that would provide sufficient cushion when the mat assembly is used. An example of such a material for the sponge insert would be a PVC/NBR foam.

An example of the material for the top plate 29 would be a flexible PCV. However, other known mat top plate materials could be employed as well in the inventive mat assembly.

Figure 6:
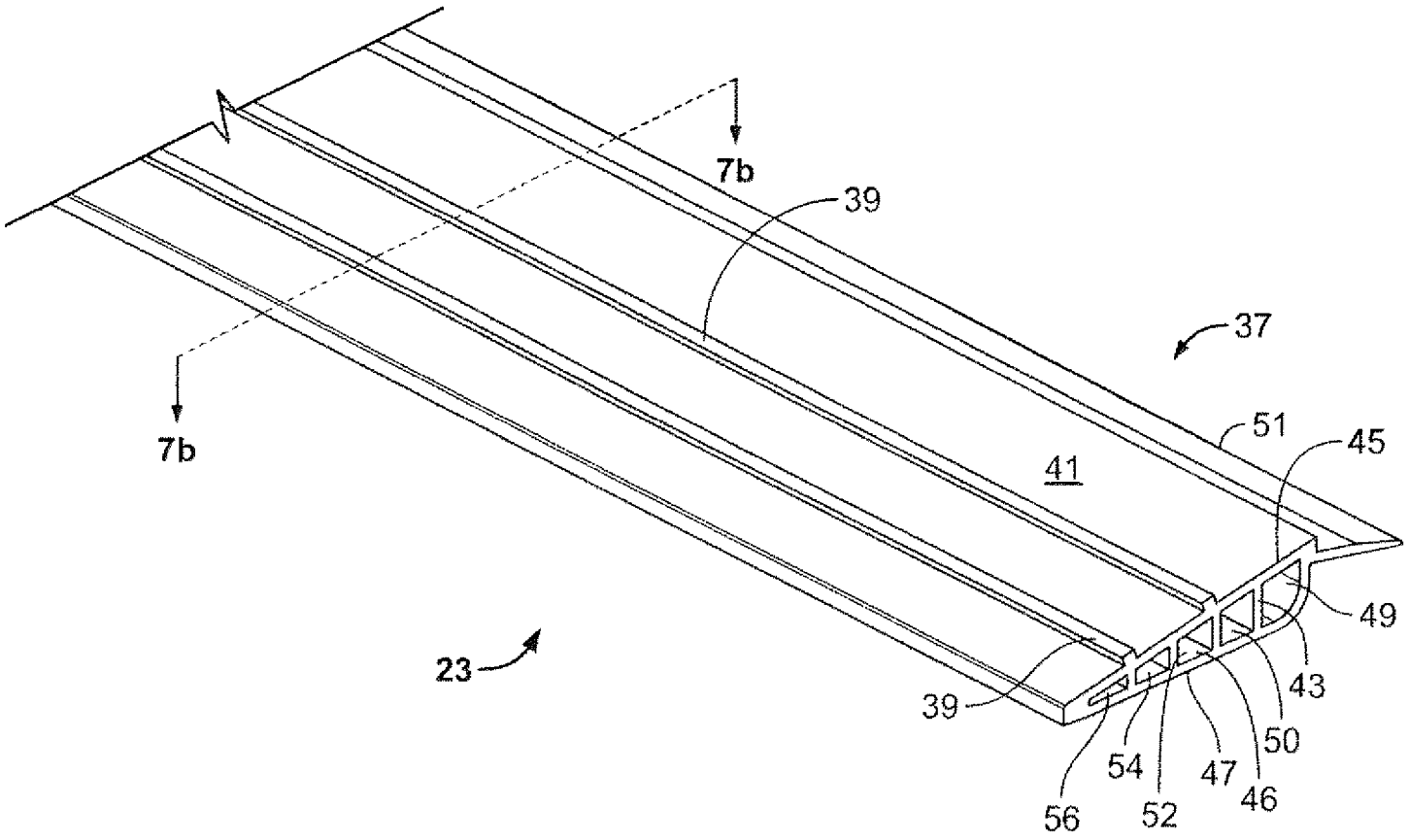
FIG. 6 shows a perspective view of a portion of one of the ramps of the mat assembly of FIG. 2.
Figure 7A:
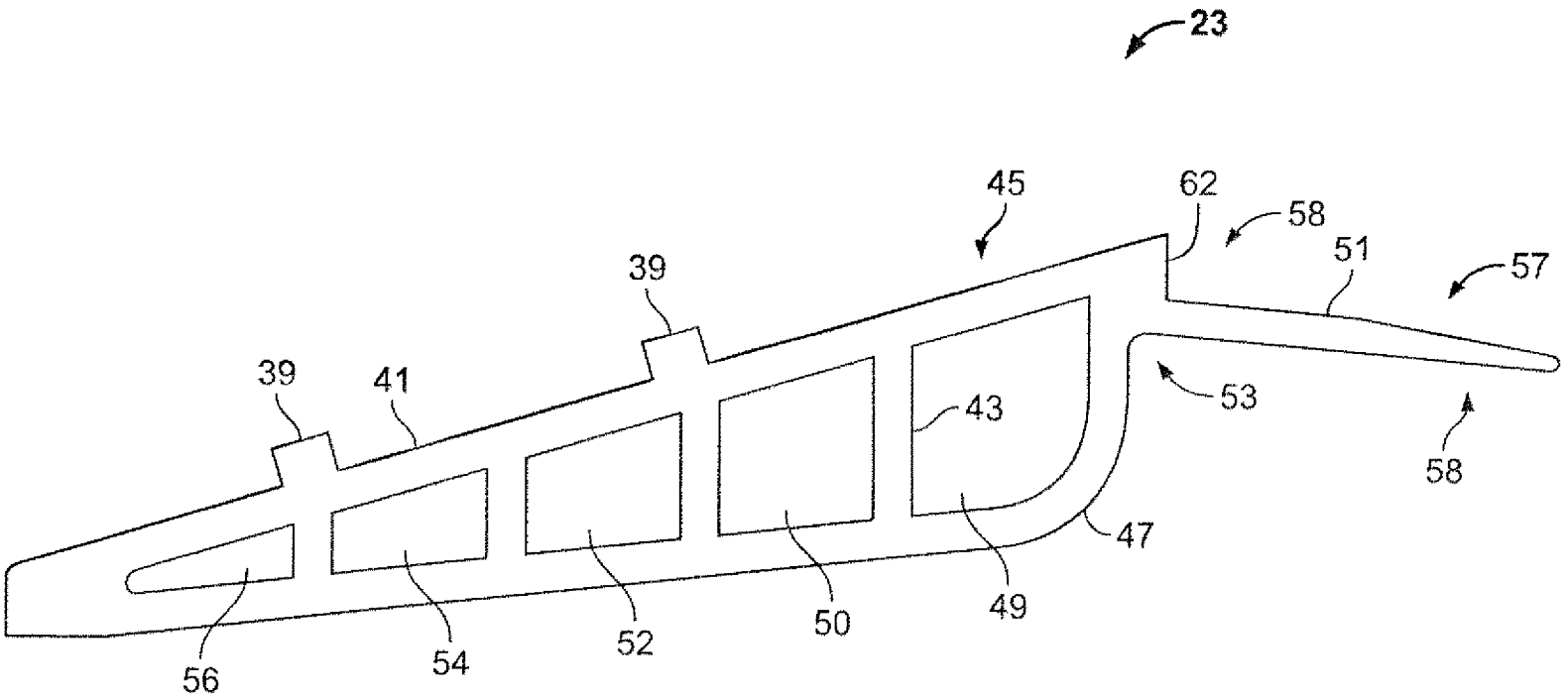
FIG. 7*a* shows a cross section view along the line 7*b*-7*b* of FIG. 6.

FIG. 6 shows a portion of the ramp 23, including an end portion 37 and FIG. 7*a* shows a sectional review of the ramp 23. The ramp 23 has a plurality of ribs 39 extending from the top surface 41 of the ramp 23 and along the length thereof. While two ribs 39 are shown, one or more ribs could be used for traction purposes for the ramp 23. The ramp is also constructed with a plurality of members 43 extending between the top portion 45 and bottom portion 47 of the ramp 23. The members 43 create a number of channels 49, 50, 52, 54, and 56 in the ramp 23. The ramp 23 also has a flange 51 that extends from end portion 53 of the ramp 23. The flange 51 also includes a tapered portion 57, wherein the cross sectional thickness of the flange decreases to the flange end 58.

Figure 7B:
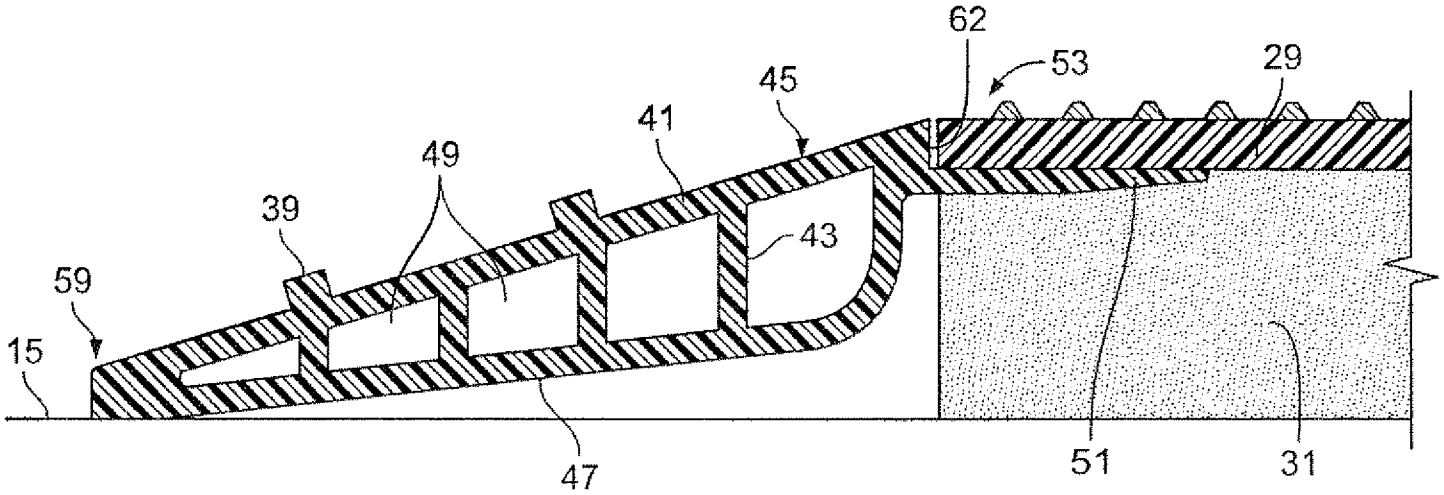
FIG. 7*b* shows a sectional view of the engagement of the ramp with the top plate and sponge layer of the mat assembly of FIG. 2.

Referring now to FIG. 7*b*, the ramp 23 and center section 21 are shown connected together with the flange 51 positioned between the sponge layer 31 and the top plate 29. The flange 51, the portion of the top plate 29 in contact therewith and the portion of the sponge layer 31 in contact with the flange are joined together to create a secure attachment of the ramp 23 to the center section 21 of the mat assembly 20. The joining can be any known type, adhesives, heat welding, or combinations thereof. By having the flange 51 between the top plate 29 and sponge layer 31, more surface areas for bonding is provided.

The ramp end portion 53 also includes a step 58, see FIG. 7*a*. This step 58 provides a face 62 that abuts an opposing face of the top plate 29 when the flange 51 is positioned in place, see FIG. 7*b*. This offers additional protection to the edge of the top plate 29 and minimizes or prevents wear of the top plate edge during mat assembly use.

As noted above, the flange 51 itself has a tapered shape so that the free end 58 of the flange has a thickness that is less than a thickness of the flange where it extends from the top portion 45 of the ramp 23. The flange 51 is also angled downwardly with respect to the floor surface or an upper surface of the top plate. The thin or tapered free end 58 is advantageous in that an outline of the free end 58 of the flange is either not seen or is less visible from the top of the mat assembly.

Referring to FIGS. 7*a* and 7*b*, the flange 51 is angled downwardly as compared to a direction perpendicular to the face 62. This perpendicular direction generally aligns with a top of the mat plate 29 as seen in FIG. 7*b* when the ramp 23 and center section 21 are assembled together to form the mat assembly. The angled flange 51 is positioned between an underside of the top plate 29 and top of the sponge layer 31 and these components are adhered together as described above. With the flange 51 positioned in a more parallel fashion to the top plate 29 as shown in FIG. 7*b*, moving the flange upward as part of the assembly of the mat provides an additional force to maintain the edge or free end 59 of the ramp 23 on the floor or ground surface.

From FIG. 7*b*, the ramp 23 is also configured such that when attached to the top plate 29 and the sponge layer 31, the bottom portion 47 of the ramp is raised from the floor surface, with only the free end 59 of the ramp 29 in contact with the floor surface 15. This arrangement avoids the problem of having to be precise on the thickness of the sponge layer 31. That is, the ramp 23 is designed so that its free end 59 is in contact with the floor surface 15. If the bottom portion 47 of the ramp 23 were also to be in contact with the floor surface 15, this would require precision in the height of the sponge layer 31. That is, if the sponge layer 31 was made too thick and the ramp 23 is attached to the center section 21, the ramp free end 59 would be raised off the floor surface 15 and possibly create a tripping hazard. With the ramp configuration shown in FIGS. 6-7*b*, there is no need to be precise with the height of the sponge layer 31. On the other hand, if the sponge layer is possibly too thin, there is no impact on the free end 59 contact with the floor. This too thin scenario merely reduces the distance between the floor surface 15 and the bottom portion 47 of the ramp.

By having the ramp bottom portion 47 spaced from floor surface 15 as shown in FIG. 7*b*, the ramp 23 can move downwardly without raising the free end 59 up. In other words, the ramp 23 can lever about the free end 59 without a concern that the free end raises up during mat assembly use. Moreover, with the use of the flange 51 and step 58, a transition area where the ramp 23 and center section 21 meet that minimizes any hard and/or abrupt feeling when moving from the soft feeling of the center section due to the sponge layer presence and the more rigid ramp construction.

In construction of the mat assembly, the top plate 29 and sponge layer 31 could be joined together but for the area where the flange 51 would be positioned. Once the flange 51 would be positioned between the top plate 29 and sponge layer 51, the joining of these components could be completed. In the alternative, the top plate 29 and sponge layer 31 could be joined together as part of the joining of the flange 51, top plate 29, and sponge layer 31.

The ramp is preferably made as an extrusion so that the rib, 39, channels 49, and flange 51 can be easily created. Any known extrudable polymer would be a candidate for the ramps, e.g., polyethylenes, polyurethanes, polypropylenes, polyvinyl chlorides and the like. Preferred material to facilitate making the ramp as an extrusion include flexible polyvinyl chloride.

Another advantage of the mat assembly is the ability to reduce the wear and tear on the ramp sections of the prior art mats. Typically, the thickness of the top plate for a prior art mat would range between 0.075-0.09 inches. Thus, when this top plate would overhang the sponge layer, it would be susceptible to tearing and curling. By providing the ramps as a component part of the mat assembly, the ramp edge thickness can be made to be twice or more in thickness as compared to the prior art thicknesses, e.g., 0.18 inches. Thus, the thicker free edges of the ramp are more resistant to wear and tear and this objective is achieved without having to increase the overall thickness of the mat plate and increase the overall cost of the mat assembly due to the use of more material.

Use of the members 43 to create channels provides strength for the ramp, while at the same time reducing the overall material needed to make the ramp and facilitate connection with the connector 27.

While it is preferred to make the ramp as an extruded structure as this saves material and cost while still allowing the ramp to have the desired strength and allows the use of connectors for the channels in the ramp to facilitate connection between ramp end portions, the ramps could be made with a solid construction. In this embodiment, channels could be formed just in the end portions of the ramps to accommodate the tree connectors of the connector 27 or the solid ends of the ramps could be bonded together.

Figure 8:
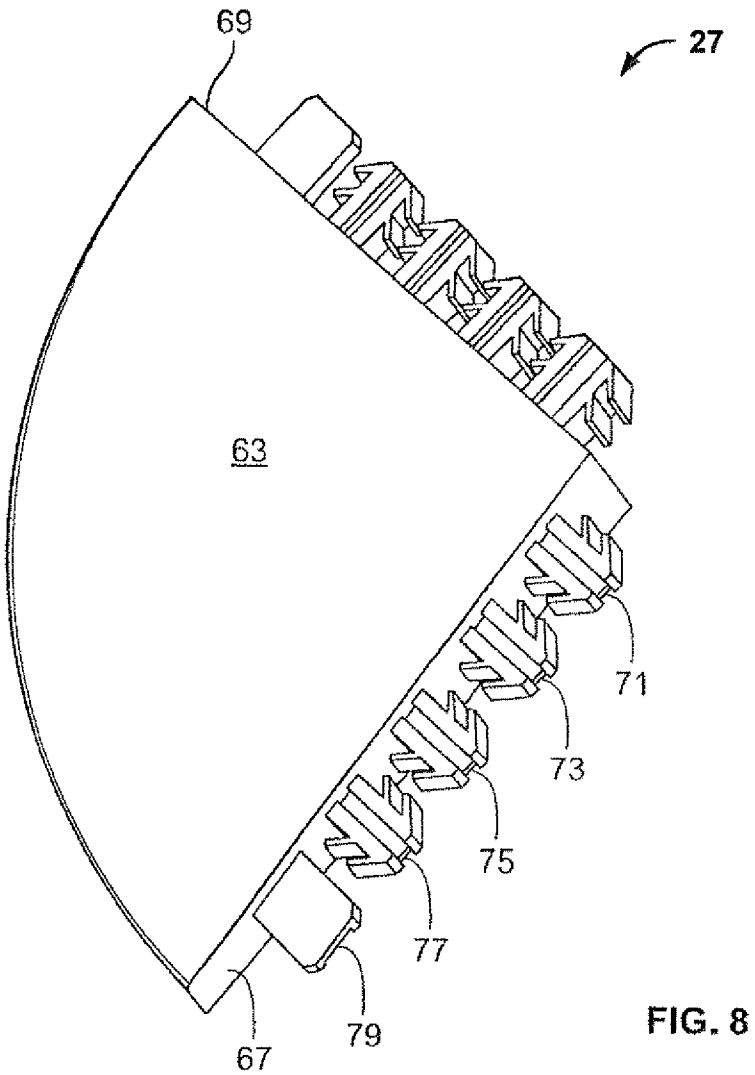
FIG. 8 shows a perspective view of one of the connectors of the mat assembly of FIG. 2.
Figure 9:
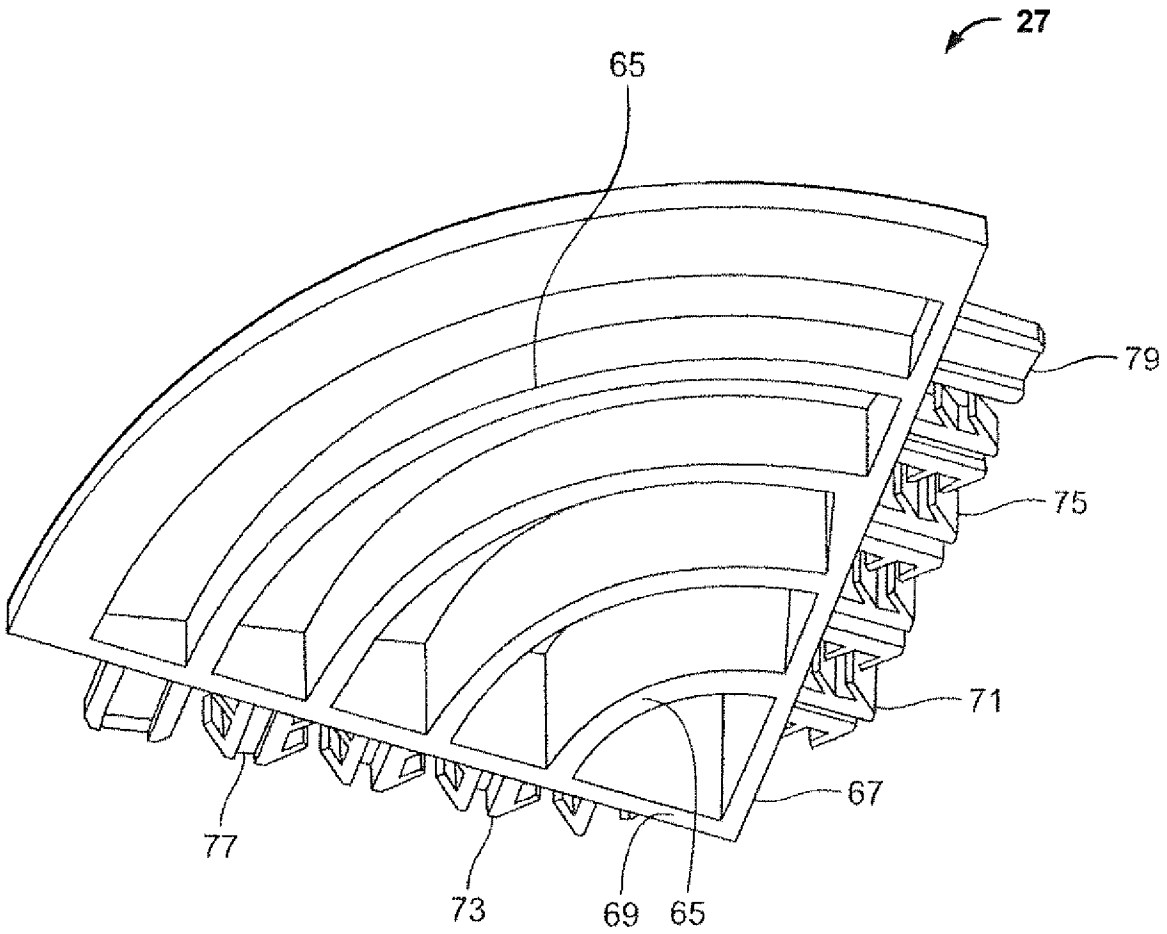
FIG. 9 shows an underside perspective view of the connector of FIG. 8.

The connector 27 is shown in more detail in FIGS. 8 and 9. FIG. 8 shows a top perspective view of the connector 27. The connector surface 63 and sides or end faces 67 and 69 of the connector 27 are configured to match the taper of the ramp 23 so that a smooth transition exists where the end of the ramp meets a side or end face of the connector 27 for mutual connection. While the connector surface 63 is shown as a smooth surface, it could also have ribs or other protrusions for traction if desired.

As shown in FIG. 9, the connector 27 could also include members 65 extending between the end faces 67 and 69 of the connector 27. The members 65 provide greater support when a weight is concentrated on the connector surface 63.

The connector 27 also includes a set of ramp connectors 71, 73, 75, 77, and 79 on each of the faces 67 and 69. Each ramp connector is uniquely sized as the channels 49, 50, 52, 54, and 56 in the ramp 23 that are designed to receive the ramp connectors are all differently sized due to the taper or incline of the ramp 23. In FIGS. 8 and 9, four of the connectors 71, 73, 75, and 77 are configured as tree connectors to provide a friction fit with a respective channel in the ramp 23 that receives the tree connector. The ramp connector 79 is tab shaped due to the small shape of the channel 56. The tree connectors are but one example of a connector configuration that would allow for an attachment between the connector faces 67 and 69 and the ends of two adjacent ramps. Other configurations that would provide a similar friction fit or even a glued fit could be used. Adhesives in combination with mechanical type connectors could also be used for ramp-connector joining.

The connectors are preferably made of the same material as the ramps to that the feel to a user of the mat assembly is generally same whether the connector or the ramp is stepped on. The connectors can be made in any way, including molding to be able to produce the intricate tree connectors.

Figure 10:
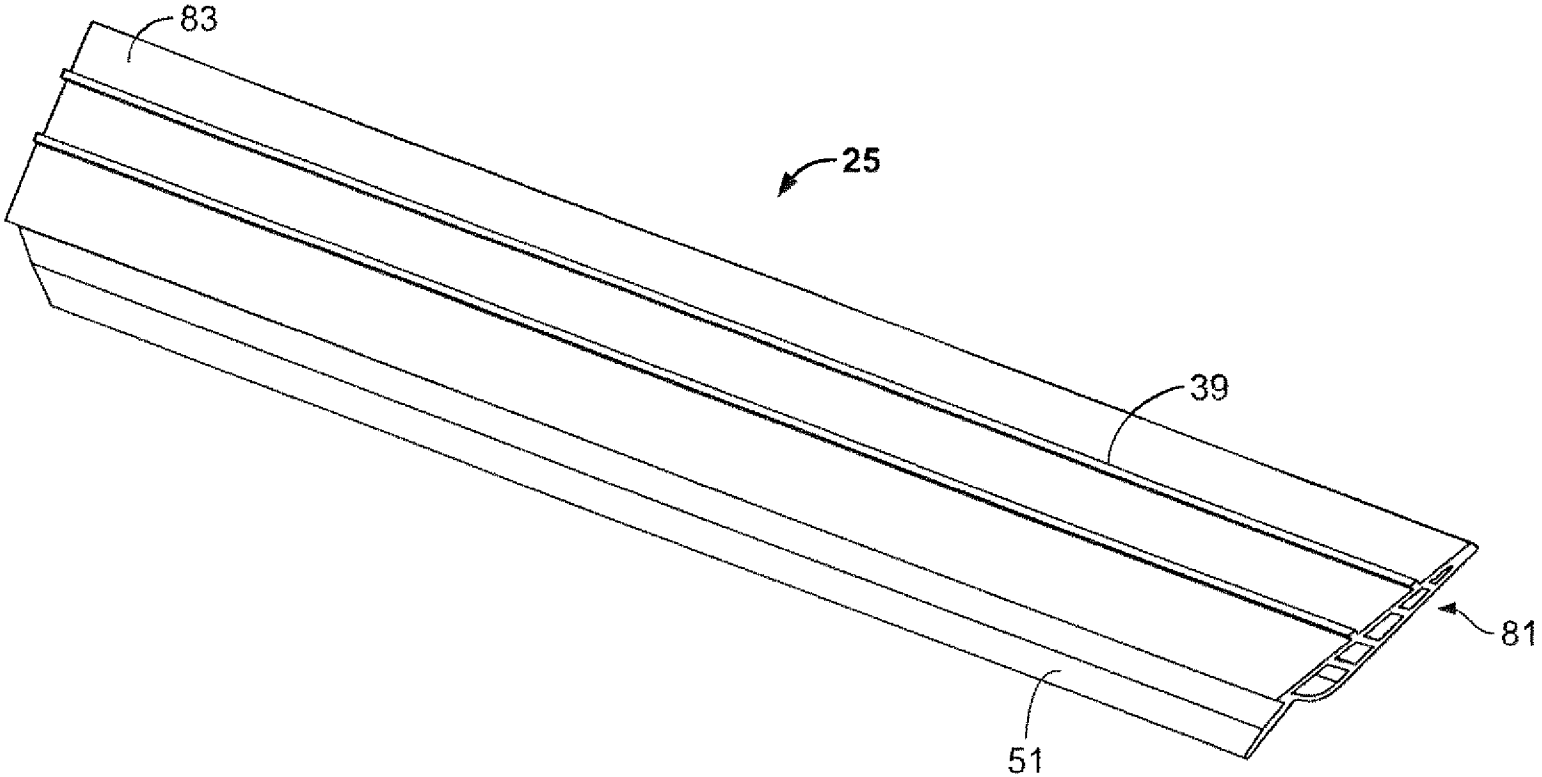
FIG. 10 shows a perspective view of another one of the ramps of the mat assembly of FIG. 2 that facilitate an alternative connection between adjacent ramps.

Referring back to FIG. 2 again and FIG. 10, instead of using the connectors 27 to terminate the opposing ramp ends that have the exposed channels, the ramp ends could be mitered to make a connection. In this embodiment, the ramp 25 of the mat assembly 10 of FIGS. 2 and 10 includes a ramp end section 81 that is mitered. The other end 83 is configured like the ends of ramp 23 so that a connector 27 can connector to the end 83. The mitered connection between the end sections 81 of adjacent ramps 25 can be made using adhesives, or fasteners, heat welding or some combination thereof. Separate fasteners could be configured to engage each of the channels in each of the ramps 25 to facilitate the mitered connection.

As noted above, the mat assembly 10 could have a combination of mitered connections and connectors 27 as shown in FIG. 2. In the alternative, just mitered connections with four of the ramps 25 could be used or four ramps 23 and four connectors 27 could be used.

The mat assembly 10 can be used in virtually any area where a cushioned area with ramp access is needed for worker use. While the mat assembly 10 is shown in a square shape, the mat assembly could also be made rectangular with two sides being longer than the other. In fact, the mat assembly could be any polygonal shape. For example, the mat assembly could be configured with six sides, and the mitered connections would be adjusted for the proper angle to join adjacent ramps or the connectors 27 could be designed such that the faces 67 and 69 would form a 60 degree angle rather than the 90 degree angle shown in FIGS. 2, 8, and 9.

Moreover, the ramp sections 23 and 25 and/or connectors 27 could be colored, e.g., yellow, to provide notice to a user as to the end of the flat part or center section of the mat assembly.

As such, an invention has been disclosed in terms of preferred embodiments thereof which fulfills each and every one of the objects of the present invention as set forth above and provides a new and improved unitary mat assembly and method of use.

Of course, various changes, modifications and alterations from the teachings of the present invention may be contemplated by those skilled in the art without departing from the intended spirit and scope thereof. It is intended that the present invention only be limited by the terms of the appended claims.

I claim:

1. A mat assembly comprising:

a center section having a peripheral portion, the center section comprising a sponge layer and a top layer, a center portion of each of the top layer and the sponge layer secured together, a plurality of ramps, each ramp having an inclined top portion, a bottom portion, and a connecting flange, one end of the inclined top portion terminating at a free end of the ramp, the free end extending longitudinally along the ramp, the ramp having a plurality of channels extending longitudinally along the ramp, adjacent channels of the plurality of channels separated by a member extending between the inclined top portion and bottom portion of the ramp, the ramp also having opposing end portions, the connecting flange positioned between an underside portion of the top layer and an upper surface portion of the sponge layer, each of which being in the peripheral portion of the center section, the connecting flange, underside portion and upper surface portion bonded together and laminated connection between each ramp and the center section, and the end portions of adjacent ramps configured to be attached together.

2. The mat assembly of claim 1, further comprising a plurality of corner connectors, each corner connector having opposing side faces, each opposing side face configured to attach to an adjacent end portion of one of the plurality of ramps.

3. The mat assembly of claim 2, wherein each opposing side face of each corner connector includes a plurality of tree connectors, each tree connector configured to engage one of the channels in the ramp.

4. The mat assembly of claim 1, wherein at least one end portion of at least two of the ramps is angled with respect to a longitudinal axis of the ramp, the angled end portions attached together by a bonding of the end portions or by use fasteners, or a combination thereof.

5. The mat assembly of claim 1, wherein the bottom portion of each ramp is inclined when the ramp is attached to the center section such that only the free end of the ramp is in contact with a floor surface.

6. The mat assembly of claim 1, wherein the flange has at least a portion that is tapered in thickness.

7. The mat assembly of claim 1, wherein the top layer has protrusions extending from an upper surface thereof for slip resistance.

8. The mat assembly of claim 1, wherein each ramp has protrusions extending from an upper surface thereof for slip resistance.

9. The mat assembly of claim 1, wherein each ramp is an extruded polymer.

10. In a method of covering a floor surface with a cushioned mat, the improvement comprising covering the floor surface with the mat assembly of claim 1.

* * * * *